United States Patent [19]

Vasconcellos et al.

[11] Patent Number: 4,681,700

[45] Date of Patent: Jul. 21, 1987

[54] PARTIAL OXIDATION OF UPGRADED PETROLEUM COKE

[75] Inventors: Stephen R. Vasconcellos, Langhorn, Pa.; Mitri S. Najjar, Hopewell Junction; Ralph Garcia, Wallkill, both of N.Y.

[73] Assignee: Texaco Inc., White Plains, N.Y.

[21] Appl. No.: 727,968

[22] Filed: Apr. 26, 1985

[51] Int. Cl.[4] ..... C10J 3/46

[52] U.S. Cl. ..... 252/373; 209/166; 209/167

[58] Field of Search ..... 252/373; 209/166, 167

[56] References Cited

U.S. PATENT DOCUMENTS

| | | | |
|---|---|---|---|
| 2,709,676 | 5/1955 | Krebs | 44/23 |
| 2,896,927 | 7/1959 | Nagle et al. | 261/35 |
| 3,458,044 | 7/1969 | Moss et al. | 209/166 |
| 3,525,434 | 8/1970 | Garrett | 209/166 |
| 3,607,157 | 9/1971 | Schlinger et al. | 48/202 |
| 3,673,080 | 6/1972 | Schlinger et al. | 44/10 R |
| 4,208,487 | 6/1980 | Wang et al. | 209/166 |
| 4,330,398 | 5/1982 | Alford | 209/166 |
| 4,377,132 | 3/1983 | Koog et al. | 48/67 |
| 4,392,981 | 7/1983 | Corbeels et al. | 252/373 |
| 4,439,314 | 3/1984 | Parlman et al. | 209/167 |

FOREIGN PATENT DOCUMENTS

| | | | |
|---|---|---|---|
| 284198 | 3/1928 | United Kingdom | 252/61 |
| 2111866 | 7/1983 | United Kingdom | 252/61 |

*Primary Examiner*—Howard T. Mars
*Assistant Examiner*—Bruce D. Gray
*Attorney, Agent, or Firm*—Robert A. Kulason; James J. O'Loughlin; Albert Brent

[57] ABSTRACT

An aqueous dispersion of unreacted particulate petroleum coke substantially comprising carbon and containing a small amount of ash substantially comprising vanadium constituents and other materials from a process for the partial oxidation of petroleum coke to produce synthesis gas is mixed with $C_4$ to $C_8$ acyclic and/or cyclic alkanols and a frothing agent. After pH adjustment, if necessary, the mixture is subjected to aeration with or without mechanical agitation in a froth flotation zone. About 60 to 95 wt. % of the unconverted particulate petroleum coke (basis carbon) particles float in the froth layer that is formed. The remainder of the unconverted petroleum coke comprising coarser particles is suspended in a bottom aqueous dispersion on which the froth layer floats. In addition, selective separation of the vanadium constituents in the unconverted petroleum coke ash takes place. The vanadium content of the ash in the floated portion of unconverted petroleum coke is unexpectedly decreased about 40 to 80 weight percent. Simultaneously, the vanadium content of the ash in the unconverted petroleum coke suspended in the bottom layer of aqueous dispersion is unexpectedly increased about 20 to 60 weight percent. Water may be recovered from this aqueous dispersion and recycled to the gas quench cooling and scrubbing zones. At least portions of the unconverted particulate petroleum coke from the foam layer and the bottom layer are recycled to the partial oxidation gas generator and to a vanadium recovery zone, respectively. By the subject process, the vanadium content in the recycle stream of unconverted petroleum coke to the gas generator is reduced. The life of the refractory lining of the gas generator is thereby extended.

6 Claims, No Drawings

PARTIAL OXIDATION OF UPGRADED PETROLEUM COKE

FIELD OF THE INVENTION

This invention relates to the gasification by partial oxidation of petroleum coke substantially comprising carbon and containing a small amount of ash comprising vanadium constituents and other materials for the production of a raw stream of synthesis gas, reducing gas or fuel gas. More particularly, it pertains to a process for reducing the vanadium content in the unconverted petroleum coke which is recovered from the raw stream of product gas and then recycled to the partial oxidation gas generator.

Crude petroleum produced in the future will be increasingly heavier and of poorer quality. These heavy oil products may be upgraded by well known delayed or fluid coking operations. For example, petroleum coke pellets may be made by a delayed coking process, as described in coassigned U.S. Pat. No. 3,673,080. A fluid coking process is described in U.S. Pat. No. 2,709,676. The contaminants originally found in the crude petroleum e.g. sulfur, heavy metals (predominately vanadium, nickel and iron), and ash will be concentrated in the petroleum coke product.

It is economical to recover the unconverted particulate petroleum coke entrained in the raw product gas stream and to recycle it to the partial oxidation gas generator as a portion of the feed. However, when this is done, the heavy metal constituents build-up in the system and may attack the refractory lined reaction zone. For example, low melting eutectics may be formed when the vanadium constituents in the ash react with the refractory lining. These eutectics melt down on the inside surface of the refractory walls, thereby decreasing the life of the refractory lining of the reaction zone. This problem and others are minimized by the subject process in which the amount of vanadium constituents in the recycle unconverted petroleum coke are substantially reduced. While coassigned U.S. Pat. No. 4,392,981 uses froth flotation, in comparison with the subject process there is no separation of vanadium constituents from the unconverted petroleum coke. Accordingly, only a frothing agent but no collection agent was used.

By the subject process, the life of the refractory lining of the reaction zone of a free-flow partial oxidation gas generator for the gasification of petroleum coke is greatly extended at a great cost savings. Further, the economics of the partial oxidation process are greatly improved by the recycling and gasification of unconverted petroleum coke.

SUMMARY OF THE INVENTION

Operation of a refractory lined free-flow partial oxidation gas generator for the production of a hot raw gas stream comprising $H_2$ and CO and containing entrained unconverted petroleum coke substantially comprising carbon and a small amount of ash comprising vanadium constituents and other materials e.g. metallic oxides and sulfides is substantially improved by the subject process. The hot raw gaseous stream from the gas generator is cooled by quenching in water or in a gas cooler and scrubbed, thereby producing a cooled and scrubbed product gas stream and a pumpable dilute aqueous dispersion of unconverted particulate petroleum coke. $C_4$ to $C_8$ acyclic and/or cyclic alkanols vanadium collection agent and a frothing agent such as pine oil are mixed with the aqueous dispersion of unconverted particulate petroleum coke. The pH of the mixture is adjusted to a value in the range of about 3 to 10, providing the mixture is not already at said pH. The mixture is then aerated with or without mechanical agitiation in a froth flotation zone. A layer of froth is thereby formed containing about 60 to 95 weight percent of the unconverted particulate petroleum coke (basis carbon). The unconverted particulate petroleum coke substantially comprises carbon and also contains a small amount of ash with a decreased amount of the vanadium constituents, in comparison with the amount of vanadium constituents in the ash in the unconverted particulate petroleum coke prior to the froth flotation treatment. The froth floats on a bottom layer of aqueous dispersion in which there is suspended the remainder of the unconverted particulate petroleum coke as coarser particulates. The coarse unconverted petroleum coke substantially comprises carbon and also contains a small amount of ash in which the amount of vanadium constituents are increased, in comparison with the amount of vanadium constituents in the ash in the unconverted particulate petroleum coke prior to the froth flotation treatment. A portion of the water is separated from the bottom aqueous dispersion layer. At least a portion of this water may be recycled to the gas quench and/or scrubbing zone. At least a portion of the unconverted particulate petroleum coke substantially comprisng carbon and also containing ash with an increased amount of vanadium constituents in the ash from the bottom layer is then sent dry or as a thickened slurry to a vanadium recovery zone. The froth layer may be burned in the partial oxidation gasifier as a portion of the feed. In one embodiment at least a portion of the unconverted particulate petroleum coke substantially comprising carbon and also containing ash with a decreased amount of vanadium constituents in the ash from the top layer may be concentrated or separated from the foam, and may be then recycled dry or as a thickened slurry to the gas generating zone as a portion of the feed.

DISCLOSURE OF THE INVENTION

Coking of heavy petroleum crudes will be a dominant upgrading process for some time to come. However, with the declining quality of refinery crudes, petroleum coke production per barrel of crude feed will increase with a corresponding drop in coke quality. A major drawback for coking is the disposal of the product coke. Since the crudes contain more contaminants, i.e. sulfur, metals (predominately vanadium, nickel, and iron), and ash, and these contaminants are concentrated in the product coke, this coke is of a much poorer quality and is excluded from its normal product applications.

Advantageously by the subject process, petroleum coke may be upgraded and then disposed of as feedstock in a free-flow partial oxidation gas generator such as that shown and described in coassigned U.S. Pat. Nos. 3,607,156 and 3,607,157, which are incorporated herein be reference. For example, particles at petroleum coke may be introduced into the free-flow partial oxidation zone as a pumpable slurry of petroleum coke in water, liquid hydrocarbonaceous fluid, or mixtures thereof. The solids content of the slurry is in the range of about 50–70 weight percent. Alternatively, an atomized aqueous dispersion or a dispersion of substantially dry petroleum coke entrained in a gaseous transport medium may be introduced into a free-flow partial oxidation gas generator. The gaseous transport medium may be selected from the group consisting of steam, $CO_2$, $N_2$, free-oxygen containing gas, and recycle synthesis gas.

Typical compositions of representative samples of fresh petroleum cokes, e.g. A and B that were used as feedstocks to the partial oxidation gas generator for the production of synthesis gas, reducing gas, or fuel gas are shown in Table I below. The elements in the ash for petroleum coke types A and B, in parts per million (PPM) are also listed in Table I.

TABLE I

TYPICAL COMPOSITION OF PETROLEUM COKE, TYPES A AND B WEIGHT PERCENT

| | TYPE A | TYPE B |
|---|---|---|
| Carbon | 98.36 | 95.50 |
| Sulfur | 1.27 | 4.11 |
| Ash | 0.37 | 0.39 |

| ELEMENTS IN THE ASH | PARTS PER MILLION TYPE A | PARTS PER MILLION TYPE B | ELEMENTS IN THE ASH | PARTS PER MILLION TYPE A | PARTS PER MILLION TYPE B |
|---|---|---|---|---|---|
| V | 520 | 1200 | Ca | 75 | 130 |
| Fe | 430 | 310 | Mg | 19 | 98 |
| Si | 440 | 110 | Zn | 12 | 3 |
| Ni | 350 | 500 | Ba | 11 | — |
| Al | 120 | 26 | Pb | 6 | 5 |
| Na | 84 | 61 | Co | 6 | 1 |

The composition of the ash from a typical delayed petroleum coke is shown in Table II below.

TABLE II

COMPOSITION OF DELAYED PETROLEUM COKE ASH

| Component | Weight % |
|---|---|
| $V_2O_5$ | 42.5 |
| $Fe_2O_3$ | 23.1 |
| NiO | 21.0 |
| CaO | 7.5 |
| SiO | 4.0 |
| $Al_2O_3$ | 1.3 |
| $TiO_2$ | 0.4 |
| $Cr_2O_3$ | 0.2 |

The solid carbonaceous fuel in the feedstream to the gasifier comprises a mixture of about 50 to 95 weight percent (wt. %) such as about 70 to 90 wt. % of fresh petroleum coke and the remainder comprises recycled unconverted petroleum coke with a decreased amount of vanadium constituents which is produced downstream in the process. The later material may be supplied dry or as slurry with water or liquid hydrocarbon fuel having a solids content in the range of about 5 to 70 wt. %, such as about 40 to 65 wt. %. Fresh petroleum coke is first comminuted to a particle size so that 100% passes through an ASTM E11-70 Standard Sieve Designation in the range of about 38 microns to less than about 1700 microns, such as about 45 microns or less to 595 microns by coarse crushing and then fine grinding in ball and rod mills.

The petroleum coke is reacted with a free-oxygen containing gas e.g. air, oxygen-enriched air, substantially pure oxygen, in the presence of a temperature moderator e.g. $H_2O$, $CO_2$, $N_2$, in the refractory lined free-flow partial oxidation synthesis gas generation zone at an autogenous temperature in the range of about 2100° F. to 2700° F., such as about 2150° F. to 2400° F., and a pressure in the range of about 1 to 200 atmospheres, such as about 6 to 60 atmospheres. The oxygen may be introduced into the reaction zone at an oxygen/carbon atomic ratio in the range of about 0.7–1.6, such as about 0.8–1.4. The $H_2O$/fuel weight ratio is in the range of about 0.5–20, such as about 0.7 to 1.0. The residence time in the reaction zone of the gas generator is in the range of about 1 to 15 seconds, say about 3 to 5 seconds.

A hot raw stream of synthesis gas, reducing gas, or fuel gas, depending on the gas composition, leaves the reaction zone of the gas generator substantially comprising in mole % dry basis: $H_2$ 2 to 40, CO 15 to 60, $CO_2$ 5 to 30, $CH_4$ 0.06 to 8.0, $COS+H_2S$ 0.1 to 3.0, $N_2$ 0.1 to 70, and A 0.1 to 1.5. Further, a small amount e.g. about 1.0 to 25 weight percent of the petroleum coke in the feed, is entrained in the raw gas stream as unconverted particulate petroleum coke.

Upon close examination, the ash associated with the unconverted particulate petroleum coke passing through a free-flow partial oxidation gas generator was found to be quite different from typical coal ash normally run in the system. Although the ash from unconverted petroleum coke did contain some of the typical coal ash components (silica, alumina, lime, etc.) in small amounts, the predominant species were compounds of vanadium, iron, and nickel. A typical proximate analysis of entrained unconverted petroleum coke from the partial oxidation gas generator is shown in Table III.

TABLE III

UNCONVERTED PARTICULATE PETROLEUM COKE FROM A PARTIAL OXIDATION GASIFIER

| | WEIGHT PERCENT | | |
|---|---|---|---|
| Fixed Carbon | 85 to 96, | such as 89 to 94, | say 91.9 |
| Ash | 0.5 to 6.0, | such as 3 to 5, | say 4.4 |
| Volatile Matter | 1.0 to 5.0, | such as 2 to 4, | say 2.97 |
| Moisture | 0.05 to 0.60, | such as 0.1 to 0.4, | say 0.36 |
| Vanadium | 0.05 to 0.50, | such as 0.1 to 0.3, | say 0.18 |

Whereas coal typically contains 10–20 wt. % ash, the unconverted petroleum coke only has one half to six wt. % ash. The remainder of the uncoverted petroleum coke substantially comprises carbon. Moreover, it is anticipated that in the petroleum coke system, a good deal of the ash material is liberated as individual molecular species. This is because upon coking, the metallic species in the crude, which are generally present as prophyrin type structures (metal atom, oxides, or ions thereof confined in an organic framework), should be entrapped within the collapsed carbon matrix. Thus, upon destruction of the carbon during the gasification process, these species would be released as exposed. Furthermore, during shut-down and subsequent exposure of the gasifier walls to air, these deposits involving vanadium can catch fire and plug the throat of the gasifier. The vanadium converts to the more fluid $V_2O_5$ or metal vanadate.

Coal gasification normally operates at greater than 98% efficiency, resulting in slag fines that are minor in abundance and which contain minimal carbon. Petroleum coke gasification is much more inefficient, with the result that large amounts of particles are produced containing appreciable percentages of carbon. It is beneficial from an economic standpoint to be able to recycle the particulate petroleum coke back through the gasifier, after the excessive concentrations of vanadium are reduced in the manner taught by the subject invention.

The subject process employs froth flotation of the unconverted petroleum coke fines via the addition of a frothing agent to produce froth and a collection agent to selectively remove a vanadium-enriched unconverted petroleum coke fraction. In particular, the collection agent is selected from the group consisting of $C_4$ to $C_8$ acyclic alkanols, $C_4$ to $C_8$ cyclic alkanols, and mixtures thereof, such as branched methyl pentanol e.g. 4-methyl-2-pentanol are employed to effect the separation. The process directs about 60–95 wt.% of the carbon in the unconverted particulate petroleum coke to the float fraction, which can then be recycled to the gas generator with or without prior concentration. The ash in the unconverted particulate petroleum coke in the float fraction contains about 40–80 wt.% less vanadium than that contained in the ash of the unconverted particulate petroleum coke prior to the froth flotation treatment. The process is a simple operation, and affords a means of easily separating vanadium-decreased unconverted petroleum coke fines from unconverted particulate petroleum coke containing an increased amount of vanadium constituents to enable the unconverted petroleum coke to be better utilized.

In the subject process, the hot raw gaseous stream from the partial oxidation gasifier may be quench cooled with water in a gas quench tank such as shown and described in coassigned U.S. Pat. No. 2,896,927, which patent is incorporated herein by reference. Most of the unconverted particulate petroleum coke is removed from the hot gas stream during the gas quenching and during additional gas washing in a subsequent scrubbing zone; for example, by means of a venturi scrubber such as shown in coassigned U.S. Pat. No. 3,607,157. Alternatively, the hot raw gaseous stream may be cooled by indirect heat exchange in a gas cooler such as shown and described in coassigned U.S. Pat. No. 4,377,132, which is incorporated herein by reference. The partially cooled gas stream may be then washed with water in a subsequent gas scrubbing zone. A cooled and scrubbed clean gas stream and a dilute aqueous dispersion of unconverted particulate petroleum coke having a solids content in the range of about 0.5 to 20.0 weight percent are thereby produced. In another embodiment, the source for the dilute aqueous dispersion of particulate unconverted petroleum coke is a stream of water which may be removed from a lock hopper or dewatering zone, e.g. lock hopper 63 or zone 67 in U.S. Pat. No. 3,607,157, and then recycled to a quench tank e.g. quench tank 20 in U.S. Pat. No. 3,607,157. The pumpable dispersion of unconverted particulate petroleum coke has a solids content in the range of about 0.5 to 10.0 weight percent, such as about 2.0 to 4.0 weight percent. The maximum size of the petroleum coke particles that pass through the reaction zone unconverted is about the same as the petroleum coke particles in the feed to the gasifier e.g. about 1700 microns. The minimum size is about 38 microns and below.

The aqueous dispersion of unconverted particulate petroleum coke is mixed with about 0.05 to 0.50 weight percent (basis weight of said aqueous dispersion of unconverted petroleum coke) of a vanadium collection agent comprising a $C_4$ to $C_8$ alkanol selected from the group consisting of acyclic alkanol, cyclic alkanol and mixtures thereof e.g. branched methyl pentanol, and about 0.5 to 5.0 weight percent of a frothing agent. By definition the term alkanol is a monohydric saturated alcohol. The collection agent has the structural formula ROH, where R is an acyclic or cyclic saturated hydrocarbon and when acylic R is a straight chain or branched saturated hydrocarbon having 4 to 8 carbon atoms and selected from the group consisting of primary, secondary and tertiary alkanols. More preferred are straight chain or branched acyclic alkanols having 4 to 8 carbon atoms with the hydroxyl group on the $C_2$ or $C_3$ carbon atom and with or without a methyl or ethyl group on anyone of the carbon atoms $C_2$ to $C_7$. The most preferred collection agent is branched methyl pentanol e.g. 4-methyl-2-pentanol.

While pine oil is the preferred frothing agent, suitable frothing agents may be selected from the group consisting of pine oil, cresylic acid, $C_5$ to $C_8$ carbon aliphatic alcohols, polypropylene glycol, and mixtures thereof.

The pH of the pumpable mixture comprising said collection agent, frothing agent, and said aqueous dispersion of unconverted petroleum coke is adjusted to a value in the range of about 3 to 10, such as 4.5 to 7.5, providing the mixture—is not already at said pH. The mixture is then introduced into a conventional flotation machine where aeration with or without mechanical agitation takes place until no more solid particles comprising carbonaceous and mineral matter are visible in the foam. For example, aeration with or without mechanical agitation may take place over a period of about 1 to 30 minutes at a temperature in the range of about 60° F. to 200° F. Suitable aerating agents may be selected from the group consisting of air, nitrogen, steam, carbon oxides, gaseous mixtures comprising $H_2$ and CO e.g. a portion of the raw product gas, and mixtures thereof. Suitable flotation machines include the Fagergren machine made by the Process Machinery Division, Arthur G. McKee & Company, or the D-R Denver machine made by the Denver Equipment Company, Division of Joy Manufacturing Company. These machines provide aeration and if required, mechanical agitation by means of a rotating impeller. They are more fully described in Chemical Engineers' Handbook-Perry and Chilton, Fifth Edition, pages 21–65 to 69, McGraw-Hill Book Co., NY, NY, which is incorporated herein by reference. Optionally, a plurality of flotation machines may be connected together in series and/or parallel and provided with recirculation of streams back through the system.

At the completion of aeration with or without mechanical agitation from about 60 to 95 weight percent of the unreacted particulate petroleum coke (basis carbon) has floated off in the froth. The previous statement means that 60 to 95 wt.% of the total carbon in the unconverted particulate petroleum coke that was subjected to froth flotation was directed to the froth fraction. The unreacted particulate petroleum coke fines that float off in the froth have a particle size of less than about 250 microns. The floated unconverted petroleum coke particles substantially comprise carbon and also contains a small amount e.g. about 0.1 to 6.0 wt.% of ash that unexpectedly contains a decreased amount of vanadium constituents in comparison with the ash in the unconverted particulate petroleum coke prior to the froth flotation treatment. The vanadium content of the ash in the floating portion of unconverted particulate petroleum coke has been unexpectedly decreased about 40 to 80 weight percent below that in the ash of the unconverted particulate petroleum coke prior to the froth flotation treatment. The froth layer may be slurried with fresh particulate patroleum coke and introduced into the partial oxidation gas generator as feed.

The remainder of the unconverted particulate petroleum coke is coarser than the fines in the froth and has a particle size of greater than about 250 microns. This fraction of unconverted particulate petroleum coke is suspended in the bottom aqueous dispersion on which the aforesaid froth floats. A small amount e.g. about 0.5 to 8.0 wt.% of ash is associated with the inconverted particulate petroleum coker in the bottom dispersion. The vanadium content of the ash in the unconverted particulate petroleum coke in the bottom aqueous dispersion has been unexpectedly increased about 20 to 60 weight percent above that of the ash in the unconverted particulate petroleum coke prior to the froth flotation treatment.

In one embodiment, the unreacted particulate petroleum coke containing ash with a decreased amount of vanadium constituents which is mixed with fresh particulate petroleum coke to constitute the fuel feed mixture to the partial oxidation gas generator is obtained by concentrating the froth layer from the froth flotation zone in a solids-liquid separation zone to produce a concentrated aqueous slurry of unreacted particulate petroleum coke having a solids concentration in the range of about 10 to 70 weight percent, or alternatively 100 wt.% solids. Said solids-liquid separation zone may include one process step from the group consisting of filtering, hydrocloning, settling, thickening, and mixtures thereof. The fuel feed mixture to the gas generator is then produced by mixing the concentrated aqueous slurry or the 100 wt.% solids from the solids-liquid separation zone with either, (1) dry fresh particulate petroleum coke substantially comprising carbon and a small amount of ash comprising vanadium constituents, or (2) slurries of said fresh particulate petroleum coke in water or in a liquid hydrocarbon fuel or in mixtures thereof. Suitable liquid hydrocarbon fuels include coal oil, shale oil, gasoline, kerosene, naphtha, gas oil fractions of petroleum distillate, benzene, toluene, hexane, heptane, cyclohexane, tetralin, decalin, fuel oil, residual fuel oil, reduced crude oil, whole crude oil, and mixtures of these various liquids. Also, water and hydrocarbon liquid fuel mixtures, suitably in the form of emulsions with an emulsifying agent, or with a gelling agent such as pectins may be used in preparing the liquid-solid carboniferous fuel slurry. The mixture of solids may be comminuted, if necessary, and then introduced into the gas generating zone.

In another embodiment, the fuel feed mixture to the partial oxidation gas generator is obtained by separating the solids substantially comprising carbon and also containing a decreased amount of ash comprising vanadium constituents in the foam layer from the solids-liquid separation zone for example by filtration; mixing said solids with fresh petroleum coke solids; comminuting said mixture of solids to a particle size so that 100% passes through ASTM E 11 Standard Sieve Designation in the range of about 1700 to 38 microns, such as less then about 250 microns if necessary; and introducing said mixture of particulate petroleum coke into said gas generating zone either with or without a carrier. Said carrier may be a gaseous material selected from the group consisting of air, $CO_2$, $N_2$, steam, gaseous mixtures comprising $H_2$ and CO, and mixtures therewith. Alternatively, said carrier may be a liquid selected from the group consisting of water, liquid hydrocarbon fuel, and mixtures thereof.

In one embodiment, at least a portion of the water which is separated from the bottom layer of aqueous dispersion in the solids-liquid separation zone is recycled to the gas cooling and/or scrubbing zones. Further, it may be profitable to send the separated unconverted particulate petroleum coke substantially comprising carbon and also containing a small amount of ash with an increased amount of vanadium from the bottom layer solids-liquid separation zone to a conventional metals recovery zone to recover vanadium.

EXAMPLE

The following examples are offered as a better understanding of the present invention, but the invention is not to be construed as limited thereto.

EXAMPLE I

An aqueous dispersion of unconverted petroleum coke having a solids content of 1.66 wt. % was obtained by quenching in water and scrubbing the hot raw effluent gas stream from the partial oxidation of an aqueous slurry of petroleum coke in a conventional Texaco gas generator. The proximate analysis of the unconverted petroleum coke was as follows:

| | Weight Percent |
|---|---|
| Fixed Carbon | 91.9 |
| Ash | 4.4 |
| Volatile Matter | 2.97 |
| Moisture | 0.36 |

The amount of vanadium in the ash was 0.18 wt. %. The maximum particle size of the unconverted petroleum coke was microns.

A branched methyl pentanol e.g. 4-methyl-2-pentanol collection agent in the amount of 0.1 wt. % and pine oil in the amount of 0.33 wt. % were mixed with a portion of the aqueous dispersion of unconverted petroleum coke contained in a conventional frothing cell. The pH of the mixture was adjusted to 6.0. Nitrogen gas was bubbled through the cell until a stable, gentle foam was produced. Frothing was continued until there were no more solid particles visible in the foam e.g. about 5.0 minutes. The top (float) layer of foam and the bottom (sink) layer of aqueous dispersion of unconverted petroleum coke were collected. The weight percent of carbon in the unconverted petroleum coke particles that were recovered by being entrained in the top (float) layer and bottom (sink) layer were 81.2 and 18.8 respectively. Samples of the unconverted petroleum coke in the float and sink were analyzed for vanadium in the ash.

Of the unconverted particulate petroleum coke in the aqueous dispersion from the gas quench and scrubbing zones, 85.9 wt. % was removed in the top (float) layer and 14.1 wt. % was removed in the bottom (sink) layer. The weight percent of ash associated with the unconverted petroleum coke particles in the top and bottom layers were 3.8 and 4.1, respectively. The ash in the top (float) had a vanadium concentration of 0.072 wt. %. This represented a decrease of 60 wt.% of the vanadium originally present in the ash portion of the unconverted petroleum coke in the aqueous dispersion prior to the froth flotation treatment. The ash in bottom (sink) layer had a vanadium concentration of 0.31 wt. %. This represented an increase of 72 wt.% of the vanadium originally present in the ash portion of the unconverted particulate petroleum coke in the aqueous dispersion prior to the froth flotation treatment, according to the subject invention. Water was separated from the bottom layer and recycled to the quench cooling and scrubbing zones. The remaining aqueous slurry of unconverted particulate petroleum coke with ash having an increased vanadium content had a solids concentration of about 60 wt. %. This aqueous slurry was sent to a vanadium recovery zone. The float layer was mixed with fresh petroleum coke, and if necessary the mixture was ground to a particle size of about 1700 microns or less. The mixture of solid fuel was then introduced into the partial oxidation gas generator, for example as an aqueous slurry having a solids concentration in the range of about 50–70 wt.%.

EXAMPLE II

The run made in Example I was repeated in all respects but with different concentrations of the 4-methyl-2-pentanol collection agent. The data in Table I clearly shows that the optimum concentration for the process is 0.1 wt.%. At that concentration of the unconverted particulate petroleum coke subjected to the subject process, 81.2 wt.% (basis carbon) was recovered in the float layer with a decreased amount of vanadium while the remainder e.g. 18.8 wt.% (basis carbon) went to the bottom layer carrying with it an increased amount of vanadium.

TABLE I

CONCENTRATION DEPENDENCE OF COLLECTION AGENT

| Fraction | 4-methyl-2-pentanol Wt. % | Wt. % Unconverted Petroleum Coke (basis carbon) |
|---|---|---|
| Top | 0.01 | — |
| Bottom | 0.01 | 100 |
| Top | 0.1 | 81.2 |
| Bottom | 0.1 | 18.8 |
| Top | 1.0 | 52.8 |
| Bottom | 1.0 | 47.2 |

The data from Examples I and II indicates that at the 0.1 wt. % concentration, the 4-methyl-2-pentanol collection agent is quite effective in increasing vanadium in the sink (bottom) fraction, yielding a 60 wt.% reduction in vanadium in the float fraction, while allowing for a carbon recovery of about 81.2 wt. %. This carbon is in the portion of unconverted petroleum coke that is suspended in the upper (float) layer and may be slurried with fresh particulate petroleum coke and recycled to the gas generator as the feed. Because of the reduced vanadium content in the ash portion of the unconverted petroleum coke, the problems discussed previously with respect to refractory attack in the gas generator are substantially alleviated.

Various modifications of the invention as herein before set forth may be made without departing from the spirit and scope thereof, and therefore, only such limitations should be made as are indicated in the appended claims.

We claim:

1. In a process for the partial oxidation of particulate petroleum coke substantially comprising carbon and containing a small amount of ash comprising vanadium constituents and other materials to produce in a gas generating zone a raw gaseous stream comprising hydrogen and carbon monoxide and containing entrained unconverted particulate petroleum coke comprising carbon and vanadium containing ash, and said gaseous stream is cooled and scrubbed with water in gas cooling and scrubbing zones to produce a cooled and scrubbed clean gas stream and an aqueous dispersion of vanadium containing unconverted particulate petroleum coke; the improvement comprising:

(1) mixing said aqueous dispersion of vanadium containing unconverted particulate petroleum coke having a solids concentration in the range of about 0.5 to 20.0 weight percent and a particle size in the range of about 38 microns and below to less than about 1700 microns with about 0.10 to 0.50 weight percent (basis weight of said aqueous dispersion of unreacted petroleum coke) of a vanadium collection agent to selectively separate a vanadium enriched unconverted petroleum coke fraction from a vanadium-decreased unconverted petroleum coke fraction, and about 0.5 to 5.0 weight percent of a frothing agent to produce froth; wherein said collection agent has the structural formula ROH where R is a straight chain or branched acyclic saturated alkanol having 4 to 8 carbon atoms with the hydroxyl group on the $C_2$ or $C_3$ carbon atom and a methyl or ethyl group on anyone of the carbon atoms $C_2$ to $C_7$: wherein said frothing agent is selected from the group consisting of cresylic acid, pine oil, polypropylene glycol, and mixtures thereof; and adjusting the pH of said mixture to a value in the range of about 3 to 10, providing the mixture is not already at said pH;

(2) aerating the mixed aqueous dispersion from (1) in a froth flotation zone with a gaseous material from the group consisting of air, nitrogen, carbon monoxide, steam gaseous mixtures of $H_2O$ and CO, and mixtures thereof, and with or without mechanical agitation forming a layer of froth which floats on a bottom layer of aqueous dispersion, wherein;

(a) said aeration is continued until no more solid particles are visible in the foam and from about 70 to 95 weight percent of the unconverted particulate petroleum coke particles (basis carbon) have floated off in the froth, and said unconverted particulate petroleum coke substantially comprises carbon and also contains a small amount of ash with a decreased amount of vanadium constituents;

(b) the remainder of the unconverted particulate petroleum coke is suspended in the bottom layer of aqueous dispersion and substantially comprises carbon and also contains a small amount of ash with an increased amount of vanadium constituents;

(c) where in comparison with the vanadium content of the ash in the unconverted particulate petroleum coke prior to the froth flotation treatment the vanadium content of the ash in the floated portion of unconverted particulate petroleum coke has been decreased about 40 to 80 weight percent and the vanadium content of the ash in the unconverted particulate petroleum coke in the bottom aqueous dispersion has been increased about 20 to 60 weight percent;

(3) concentrating the froth layer from (2) (a) in a solids-liquid separation zone to produce a concentrated aqueous slurry of unconverted particulate petroleum coke with a decreased amount of vanadium constituents and having a solids concentration in the range of about 10 to 70 weight percent, and said concentrated aqueous slurry is mixed with either, (1) dry fresh particulate petroleum coke substantially comprising carbon and a small amount of ash comprising vanadium constituents, or (2) slurries of said fresh particulate petroleum coke in water or in a liquid hydrocarbon fuel or mixtures thereof;

(4) recycling to said partial oxidation gas generating zone at least a portion of the slurry from (3); and (5) concentrating the bottom layer of aqueous dispersion from (2) (b) in a solids-liquid separation zone to produce water and a concentrated aqueous slurry of unconverted particulate petroleum coke with an increased amount of vanadium constituents and having a solids concentration in the range of about 10 to 70 weight percent or alternatively 100 weight percent solids, and said concentrated aqueous slurry or alternatively 100% solids is sent to a vanadium recovery zone while the separated water is recycled to the gas cooling and scrubbing zones.

2. The process of claim 1 wherein said collection agent is branched methyl pentanol.

3. The process of claim 1 wherein said collection agent is 4-methyl-2-pentanol.

4. The process of claim 1 where in (2) said mixed aqueous dispersion from (1) is agitated for a period of about 1 to 5 minutes, at a temperature in the range of about 60° to 200° F., and a pH in the range of about 4.5 to 7.5.

5. The process of claim 1 wherein water is separated in said solids-liquid separation zone by at least one process step selected from the group consisting of filtering, hydrocloning, settling, thickening, and mixtures thereof.

6. The process of claim 1 provided with the additional steps of slurrying froth layer from 2(a) with fresh unconverted petroleum coke to produce an aqueous slurry having a solids concentration in the range of about 50–65 wt. %, and said slurry is introduced into the partial oxidation gas generating zone in (4).

* * * * *